United States Patent [19]

Choate

[11] 4,360,002

[45] Nov. 23, 1982

[54] LOG-BURNING STOVE

[76] Inventor: James R. Choate, P.O. Box 2409, Sampson Rd., Rochester, N.H. 03867

[21] Appl. No.: 217,841

[22] Filed: Dec. 18, 1980

Related U.S. Application Data

[63] Continuation-in-part of Ser. No. 962,042, Nov. 20, 1978, Pat. No. 4,240,399, which is a continuation-in-part of Ser. No. 789,517, Apr. 21, 1977, Pat. No. 4,131,104.

[51] Int. Cl.[3] ..... F23M 7/00

[52] U.S. Cl. ..... 126/190; 126/193; 126/83

[58] Field of Search ..... 126/193, 198, 160, 177, 126/174, 162, 201, 202, 298, 336, 57, 83, 190, 126, 80, 83, 141, 148; 110/173 B, 173 C, 180, 293, 310, 326

[56] References Cited

U.S. PATENT DOCUMENTS

| | | | |
|---|---|---|---|
| 98,806 | 1/1870 | Searle | 126/190 |
| 128,254 | 6/1872 | Sanford | 126/190 |
| 1,726,794 | 9/1929 | Anetsberger | 126/190 |
| 1,861,010 | 5/1932 | Hoffstetter | 126/190 |
| 2,743,720 | 5/1956 | Dollinger | 126/140 |
| 2,814,287 | 11/1957 | Shults | 126/140 |
| 4,117,824 | 10/1978 | McIntrie | 126/140 |
| 4,180,051 | 12/1979 | Maier | 126/80 |

*Primary Examiner*—Samuel Scott
*Assistant Examiner*—G. Anderson
*Attorney, Agent, or Firm*—Richard P. Crowley

[57] ABSTRACT

A log-burning stove having a stove door with an angled plate element secured thereto, the top portion of the plate element deflecting combustion gases inwardly to the combustion chamber, and the lower portion deflecting draft air inwardly and downwardly into the combustion chamber, the plate element also forming a log-support and log-sliding surface.

8 Claims, 4 Drawing Figures

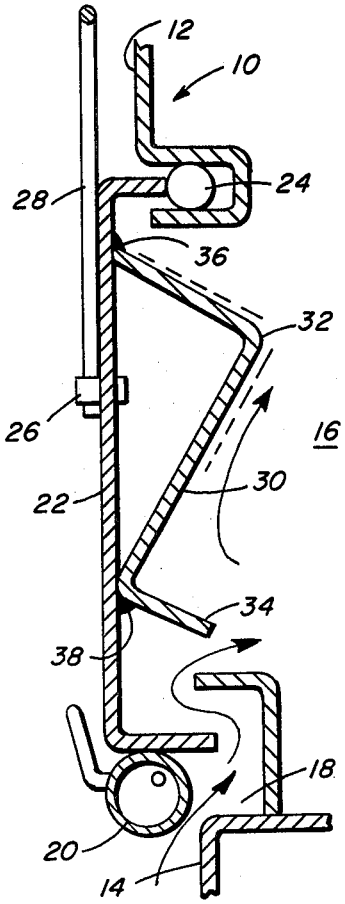
FIG. 1
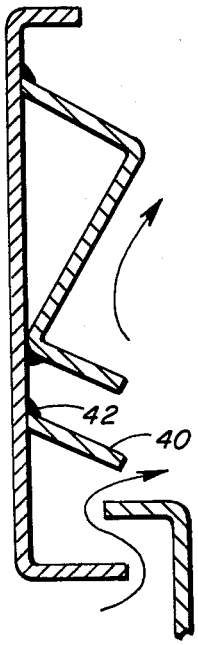
FIG. 3
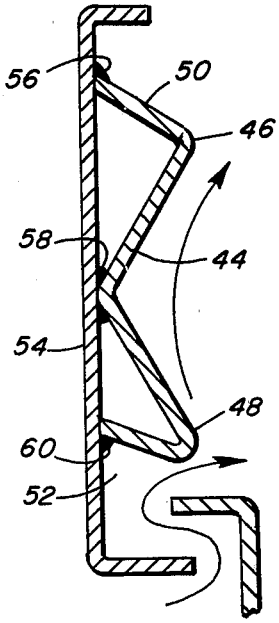
FIG. 4
FIG. 2
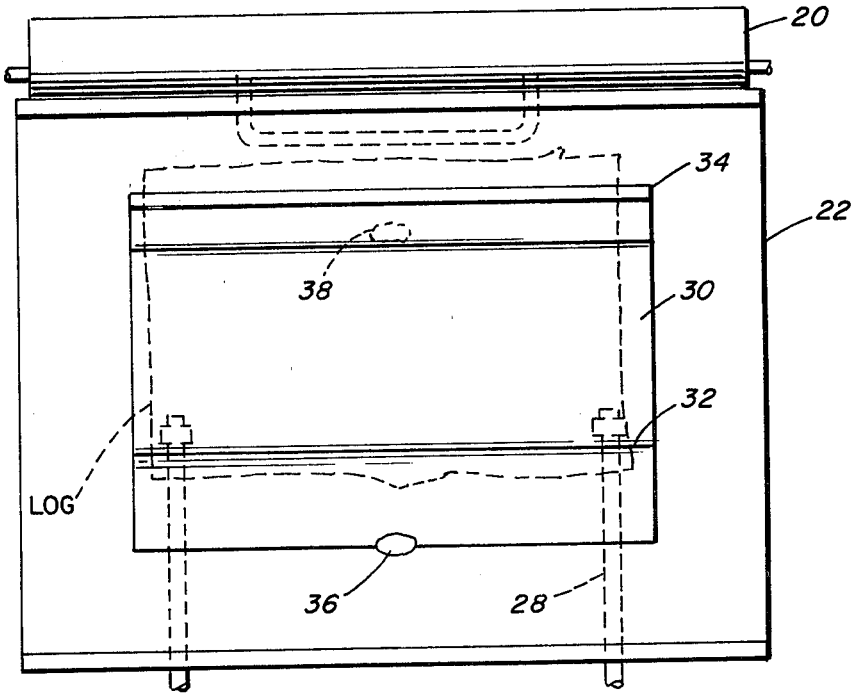

LOG-BURNING STOVE

REFERENCE TO PRIOR APPLICATION

This application is a continuation-in-part of U.S. Ser. No. 962,042, filed Nov. 20, 1978, hereby incorporated by reference (now U.S. Pat. No. 4,240,399, issued Dec. 23, 1980), which application is a continuation-in-part of U.S. Ser. No. 789,517, filed Apr. 21, 1977 (now U.S. Pat. No. 4,131,104, issued Dec. 26, 1978).

BACKGROUND OF THE INVENTION

Wood stoves, particularly log-burning stoves, are often unsatisfactorily designed for the loading and burning of heavy logs. U.S. Pat. No. 4,131,104, issued Dec. 26, 1978, discloses an improved log-burning stove, wherein the stove door has been modified to provide for a plurality of free-wheeling rollers in the plane of the stove door, whereby heavy logs may be placed on the roller surface and positioned easily in front of the combustion-chamber opening, when the stove door is open, and then the log may be introduced into the combustion chamber by rolling the log or by raising the stove door.

U.S. patent application Ser. No. 962,042, filed Nov. 20, 1978 (hereby incorporated by reference) and which is a continuation-in-part of the application which matured into U.S. Pat. No. 4,131,104, discloses a further improvement in log-burning wood stoves, particularly in the design of the stove door. The improved log-burning stove includes a stove door leading to a combustion chamber, which door comprises a plurality of spaced-apart, generally parallel, raised, fixed rib elements on the interior of the stove door. The design and construction of the rib elements in the stove door were designed and serve to strengthen the door and to provide an upper surface of the rib elements upon which the heavy logs may be slid easily in position and introduced into the combustion chamber; for example, by raising the stove door from the open, extended to the closed position.

While the improved log-burning stove represents an advance in the art, it has been found in practice that the use of the fixed rib elements on the stove door may have certain disadvantages under high heat conditions. The fixed rib elements served, firstly, to strengthen the stove door, and, secondly, to provide at least two central rib elements or ways for the sliding of the heavy logs. It has been discovered that, in this particular construction, wherein the stove door opens from top to bottom; that is, extends horizontally outwardly from the lower section of the combustion opening in use, the top of the stove door tends to become quite hot during operation of the stove, and particularly where an elongated draft opening is employed under the bottom of the door, as set forth, for example, in U.S. Pat. No. 4,154,211, issued May 15, 1979. The difference in temperature between the top and the bottom of the stove door has been found to create a twisting force, due to the difference in expansion of the fixed rib elements secured to the door surface, which twisting force may warp the stove door. Further, inquiry has indicated that the fixed rib elements, which usually are welded to the door along the full length thereof for strength purposes, projected more inwardly than the outer peripheral door frame, and, thus, tended to be closer to the flame of the combustion chamber and to expand linearly slightly more than the door frame, which may compound the disadvantages associated with the difference in temperature between the top and bottom of the stove door.

Thus, it is desired to provide an improved log-burning wood stove which will overcome the disadvantages recited and to permit heavy logs to be positioned and introduced into the combustion chamber, without causing any damage to the stove door.

SUMMARY OF THE INVENTION

My invention concerns an improved log-burning stove and a method of manufacturing the stove and of using the stove. In particular, my invention relates to an improved log-burning stove which includes means for positioning a log on the stove door for easy introduction into the combustion chamber, which stove door also includes means to overcome the disadvantages of high heat conditions which may exist between the top and bottom of the stove door.

My invention provides for a log-sliding surface on the interior of the stove door, for the positioning and introducing of heavy logs into the combustion chamber of the stove, but without the disadvantages associated with the use of fixed and raised rib elements secured to the interior of the door surface. My improved stove includes baffle-type means for equalizing the actual stove-door temperature in use between the top and the bottom of the stove door and includes heat-baffle means on the stove door, to prevent the heat of the combustion chamber from radiating directly onto the interior of the top portion of the stove door. My improved stove door and baffle means direct heat and hot gases to flow and turn out at an angle from the plane of the door surface and to induce a rolling action of the hot combustion gases between the top and the bottom of the stove door. This rolling action in practice tends to reduce any differences in heat and temperature between the top and the bottom of the stove door. Further and importantly, the flow of gases tends to return the heavy, unburned, gaseous combustion by-products of the stove back into the combustion chamber, while permitting the cleaner, lighter and hotter combustion gases to exit into the upper part of the stove and outwardly through the upper plenum chamber of the stove and to the flue. Where an upper plenum chamber is employed, this rolling, gaseous flow action permits the lighter hot gases to give up their heat in the upper plenum chamber of the stove, prior to passing into the atmosphere.

My invention comprises a log-burning stove which comprises a shell which defines a combustion chamber for the combustion of logs or other combustible material and a flue for the discharge of gaseous combustion products derived from the combustion of the material, and, optionally, where desired, an upper flue plenum chamber. The stove also includes an entrance in one vertical wall of the shell into a combustion chamber, whereby logs and other materials may be introduced into the combustion chamber for burning. A stove door is adapted to be placed in an open or a closed position, and the stove door is placed in a closed, upright position, to seal the entrance of the combustion chamber, and, in the open position, extends generally laterally outwardly from the lower bottom edge of the entrance of the combustion chamber by means which provide for the movement of the door between an open and a closed position. Optionally, draft-control means, to control the flow of draft air into the combustion chamber, may be employed, such as a draft-control means set forth in U.S. Pat. No. 4,154,211, wherein an elongated opening is placed and extends between the lower edge of the door and the lower edge of the entrance, and a draft-closure means of an eccentric shaft is employed, which moves between a draft-closure and a draft-opening position, to open and close the elongated draft opening.

My improvement comprises and includes an integral plate-type element, typically of a heavy metal; for example, bent or formed, secured to the interior of the door surface and secured at an angle to the plane of the stove door, with the top of the plate element extending generally outwardly from the plane of the stove door and inwardly, at the top of the stove door, toward the combustion chamber, whereby hot combustion gases, moving up the surface of the draft-deflection plate element, are directed outwardly when passing from the bottom to the top of the stove door. In my preferred embodiment, a draft-deflection element is employed, having a generally Z-shaped, cross-sectional configuration.

In addition to the plate-type element, my stove door my also include, optionally, one or more longitudinal, raised, rib elements at the lower portion of the stove door, in order to provide additional support for a log to be placed on the plate-type element. In one embodiment, a single, raised, rib-like element is employed, extending longitudinally across the lower half of the stove door, in conjunction with a raised draft-deflection element. However, if desired, the draft, raised, deflected element also may serve, at its upper surface, as a raised, longitudinal, rib element, so as to provide a dual function of supporting the log and also serving to deflect draft air at the lower portion of the stove door.

In one embodiment, the integral, heavy, metal, draft-deflection plate element has a generally Z-shaped, cross-sectional configuration, wherein one end of the plate element, toward the bottom of the combustion opening, and the other bent section of the element, in combination, form a log-sliding and log-support surface for a log placed in the door in the open position. The plate element may extend at various angles, typically 15° to 30° from the plane of the door, and generally extends from the top portion of the stove door toward the bottom portion, or at least over a majority of the length, of the stove door and the width of the stove door.

The draft deflector and baffle of my invention, on the interior of the stove door, provide for both the deflection of hot gases and a log support surface. Further, the general Z-shaped, sectional configuration of the deflector baffle allows for vertical expansion and contraction (that is, top to bottom of the door) of the deflector baffle, with a reduction in force transmitted to the stove door or the welding or securing area by which the deflector baffle is secured to the interior of the stove door. The bent or formed section of the baffle, which extends inwardly toward the combustion chamber, when the stove door is in the closed position, absorbs the forces of expansion and contraction. In addition, the baffle allows horizontal expansion of the baffle in use, with little or no strain on the spot-welds or other means used to secure the baffle to the stove door. The configuration of the baffle performs the function of a raised log-support and log-sliding surface on the door, and also deflects the incoming draft air from the lower draft opening downwardly into the combustion chamber, while the upper, convex bend of the Z-baffle directs the smoke and gases to curl inwardly into the combustion chamber.

It is important that the baffle plate be secured to the stove door, typically by a spot-weld only in the general central area, when the one end at the top of the stove door and the bent or formed section of the baffle toward the lower portion of the stove door are secured to the stove door. The use of a single secure spot or weld avoids torque problems associated with multiple spot-welds or a continuous weld.

The stove door and the plate element employed usually are of metal, and the rib and plate elements are welded to the interior surface of the stove door. It has been found, further, that it is most advantageous to weld the plate element and the rib elements to the stove door only in a single, central section, and not throughout the entire length thereof, in order to permit heat-expansion to occur, without exerting any twisting force on the stove door.

In another embodiment, which will be illustrated, a pair of plate elements may be employed, assuming a general M-type, cross-sectional structure, with the ends of the plate elements at the top and the bottom of the stove door raised, while the opposite ends bend toward the center of the stove door and typically are joined at the lower level, to provide an intermediate section between the top and the bottom of the stove door, to present two plate surfaces to provide a surface for sliding a heavy log into position and which, in addition, protect the stove door from excess heat conditions at both the top and the bottom, but preferably, of course, at the bottom, where high heat conditions are obtained.

My improved log-burning stove and the improved stove door will be described for the purpose of illustration only in connection with certain embodiments. However, it is recognized that various changes and modifications may be made in the described embodiments by those persons skilled in the art, without departing from the spirit and scope of my invention.

BRIEF DESCRIPTION OF THE DRAWINGS

FIG. 1 is an illustrative, fragmentary, cross-sectional view of my improved log-burning stove, with the stove door in a closed position;

FIG. 2 is an illustrative, top plan view of the stove door of FIG. 1;

FIG. 3 is an illustrative, fragmentary, cross-sectional view of another embodiment of the stove door of my invention; and FIG. 4 is an illustrative, fragmentary, cross-sectional view of a further embodiment of the stove door of my invention.

DESCRIPTION OF THE EMBODIMENTS

FIGS. 1 and 2 show a log-burning stove 10, as, for example, in U.S. Pat. No. 4,131,104, having front top and bottom vertical walls 12 and 14 in the stove shell, which defines a combustion chamber 16 for the combustion of materials, particularly logs. The entrance to the combustion chamber 16 in the vertical wall contains a downwardly hinged stove door 22, shown in the closed position. An elongated draft opening 18 extends along the bottom of the stove door 22 in the bottom wall 14 substantially the length of the combustion chamber, to admit draft air into the chamber. An eccentric, movable rod 20, shown in the open position, is employed to control the amount of draft air through opening 18 into the chamber 16.

The top wall 12 contains a fireproof sealing gasket 24, such as of asbestos or other material, so that the top of the door can be placed in a closed, sealing position. The stove door 22 is hinged (not shown) at the bottom wall 14, to open outwardly and extend from the bottom wall 14. The door 22 contains a welded-in lock nut 26 on one side, with a handle pivot bolt on the other side, to retain a pivot handle 28 for opening and closing the stove door 22.

The door 22 includes a metal-plate baffle element 30, having a general cross-sectional Z-shape, with the upper bent or formed section 32 extending inwardly toward the combustion chamber 16, with a height greater than the door opening, and with the bent section disposed toward the top of the door 22. The lower extension 34 of the baffle 30 is positioned at a draft-deflection angle; for example, 30° to 45°, from the perpendicular plane of the door 22, while the surface of the baffle extends at an angle of from 15° to 30° from the plane of the door 22. The metal baffle 30 is secured to the metal stove door by centrally positioned spot-welds 36 and 38, as shown more particularly in FIG. 2.

In operation of the stove 10, the upper bent section 32 protrudes into the combustion chamber 16 and forms an angled surface, so that hot combustion gases and smoke from the chamber 16 are forced angularly inwardly, to induce a rolling gas-flow action, as generally illustrated by the flow arrows of the drawing. This inward baffling or deflecting of the hot gases protects the upper portion of the stove 22 from excessive heat and heat warpage. The downwardly deflecting extension 34, whose angle of deflection may be varied as desired, extends generally downwardly over and across the length of the elongated draft opening 18, to force incoming draft air downwardly into the combustion chamber 16, to induce better combustion, as generally illustrated by the flow arrows of the drawing.

The baffle 30 configuration also permits vertical expansion of the baffle 30 inwardly toward the combustion chamber 16 during stove operation, as generally illustrated by the dotted heat-expansion lines in FIG. 1. The vertical heat expansion (and later cold contraction) of the baffle 30 occurs with little force transmitted to the stove door 22 or the spot-welds 36 and 38, as the bent section 32 of the baffle 30 absorbs the heat-expansion forces. In addition, the baffle 30 also may heat-expand (and cold-contract) horizontally, with little force or strain on the door 22 or the spot-welds 36 and 38, as generally illustrated by the dotted expansion arrows. The heat expansion and cold contraction, both vertically and horizontally, without distortion of the stove door, require that the baffle be secured generally centrally and by a single securing means, such as spot-welds 36 and 38, to two contact spots of the baffle 30 with the door 22. Where expansion of the baffle does not create disturbing forces, then the baffle may be secured by a plurality of spot-welds as desired.

When the door 22 is placed in the open position; that is, extends generally outwardly and perpendicularly from the plane of the stove walls 12 and 14, the upper bent section 32 and extension 34 and the section therebetween function as a log-support and log-sliding surface, so that heavy logs may be placed thereon by sliding the logs from the one or the other side of the door 22. Thereafter, the logs may be introduced into the chamber 16 by lifting the stove door 22, using handle 28, to place the door in a closed position and to lift the logs and deposit them in the chamber 16.

The stove door provides for vertical and horizontal expansion of the baffle, without door-distorting forces being developed, forces draft air downwardly into the chamber, induces hot gases inwardly for more efficient combustion and protects the upper portion of the door from excessive heat, while also providing a log-support and log-sliding surface.

FIG. 3 is a modification of the stove door of FIGS. 1 and 2, wherein a separate, angled, metal draft-deflector plate 40 is employed, secured to the metal door by a central spot-weld 42. In operation, the draft deflector 40 is angled to deflect draft air downwardly in the chamber 40, while the baffle 30 functions to induce a rolling action of the combustion gases.

FIG. 4 is a further modification of the stove door of my invention which employs a baffle 44, having the general cross-sectional shape of an M, with a top, angled bend 46, a lower bend 48 and extending upper and bottom legs 50 and 52 and a central leg 54 secured by single, central spot-welds 56, 58 and 60. The lower leg 52 functions as an air-draft deflector, while the upper leg 50 and the surface of the baffle force combustion gases inwardly. If desired, a separate rib element, as an air-draft deflector as in FIG. 3, may be employed with the M-shaped baffle of FIG. 4.

The advantages of my inwardly extending, angular baffles may be secured, in connection with stoves in general, without the necessity of an elongated, draft-air opening, but may be used with conventional wood-burning stoves, where a log-support surface is desired and/or where heat-distortion of the stove door causes difficulties. My improved log-burning stove, therefore, provides for distinct advantages over log-burning stoves of the prior art.

What I claim is:

1. A log-burning stove which comprises:

(a) a shell defining a combustion chamber for the combustion of logs;

(b) a flue for the discharge of gaseous combustion products derived from combustion of the logs in the combustion chamber;

(c) an entrance in one wall of the shell and into the combustion chamber for the introduction of logs;

(d) a stove door having a top and a bottom portion and adapted to be placed in an open and a closed position, and which door, in the closed, upright position, seals the entrance, and, in the open position, extends generally laterally outwardly from the lower bottom edge of the entrance;

(e) means to provide for the movement of the door between an open and a closed position; and (f) a metal baffle element composed of an integral piece of metal extending generally and substantially the length and width of the stove door, the baffle element having a generally cross-sectional shape of the letter Z and composed of upper and lower generally parallel rib elements and an intermediate angular section having generally flat surface, the baffle element secured to the interior of the stove door, so that the surface of the intermediate angular section of the Z-shaped baffle element extends away from and inwardly into the combustion chamber at the top portion of the stove door, when the stove door is in a closed position, whereby the baffle element protects the upper portion of the stove door from excessive heat, and hot combustion gases moving upwardly along the angular section of the baffle element are directed inwardly toward the combustion chamber, and whereby the baffle provides a supporting surface for the positioning and introducing of logs into the combustion chamber.

2. The stove of claim 1 which includes an elongated draft opening positioned just below the lower entrance of the combustion chamber and in the front wall of the shell, and means to open and close the opening, and wherein the stove door includes, in the lower portion thereof, an elongated air-draft-deflector element placed at an angle, which draft-deflector element, when the stove door is in the closed position, extends into a draft-deflecting position and directs air inwardly and downwardly into the combustion chamber.

3. The stove of claim 1 wherein the baffle element extends at an angle of about 15° to 30° from the plane of the interior surface of the stove door.

4. The stove of claim 1 wherein the lower rib element of the baffle element has a height equal to or less than the height from the inside surface of the door of the inwardly extending angular section of the baffle at the top portion of the door.

5. The stove of claim 1 which includes a spaced-apart, angled rib element extending generally longitudinally across and secured to the lower interior of the stove door below the lower section of the baffle element, the spaced-apart rib element forming a draft-deflection element, to deflect draft air inwardly and downwardly into the combustion chamber.

6. The stove of claim 1 wherein the baffle element is secured to the interior surface of the stove door by a pair of generally centrally positioned securing means, one securing means secured centrally at the top of the door interior and the other securing means secured centrally at the bottom of the door interior, thereby permitting expansion and contraction of the baffle plate element, without distortion of the stove door.

7. The stove of claim 6 wherein the securing means comprises a single weld at the top and bottom portions of the baffle element.

8. A log-burning stove which comprises:

(a) a shell defining a combustion chamber for the combustion of logs;

(b) a flue for the discharge of gaseous combustion products derived from combustion of the logs in the combustion chamber;

(c) an entrance in one wall of the shell and into the combustion chamber for the introduction of logs;

(d) a stove door having a top and a bottom portion and adapted to be placed in an open and a closed position, and which door, in the closed, upright position, seals the entrance, and, in the open position, seals the entrance, and, in the open position, extends generally laterally outwardly from the lower bottom edge of the entrance; and (e) means to provide for the movement of the door between an open and a closed position, which stove door comprises (i) a metal baffle element composed of an integral metal piece extending generally and substantially the length and width of the stove door, the baffle element bent into a generally cross-sectional shape of a Z and composed of upper and lower generally parallel rib elements and an intermediate angular section having generally flat surface, the baffle element secured to the stove door, so that the surface of the intermediate angular section of the Z-shaped baffle element extends away from and inwardly into the combustion chamber at the top section of the stove door, whereby hot combustion gases, flowing upwardly along the angular section of the baffle element, are forced inwardly toward the combustion chamber, and whereby the baffle provides a supporting surface for the positioning and introducing of logs into the combustion chamber;

(ii) a raised rib element extending generally longitudinally across the lower portion of the stove door and under the baffle element, (iii) the stove including an elongated draft opening positioned just below the lower entrance of the combustion chamber and in the front wall of the shell, (iv) means to open and close the elongated draft opening, so as to admit and control the draft air entering the combustion chamber, (v) the rib element positioned at a downward and inward angle, so that draft air from the elongated draft opening is deflected downwardly and inwardly into the combustion chamber, (vi) means to secure the baffle element at upper and lower contact points with the stove door, and to secure the rib element to the stove, which means comprises a single, generally centrally disposed securing means for each contact line of the elements, to permit expansion and contracting of the elements during stove operation, without distortion to the stove door.

* * * * *